US006264547B1

(12) United States Patent
Wälti

(10) Patent No.: US 6,264,547 B1
(45) Date of Patent: Jul. 24, 2001

(54) SPRAYING BOOTH AND CIRCULATION SYSTEM FOR A WORKING CHAMBER

(76) Inventor: Robert Wälti, Sonnhaldenstrasse 2, CH 9552Bronschhofen (CH)

( * ) Notice: Subject to any disclaimer, the term of this patent is extended or adjusted under 35 U.S.C. 154(b) by 0 days.

(21) Appl. No.: 09/331,548

(22) PCT Filed: Dec. 15, 1997

(86) PCT No.: PCT/CH97/00468

§ 371 Date: Jun. 17, 1999

§ 102(e) Date: Jun. 17, 1999

(87) PCT Pub. No.: WO98/28088

PCT Pub. Date: Jul. 2, 1998

(30) Foreign Application Priority Data

Dec. 20, 1996 (EP) ..... 96120695

(51) Int. Cl.[7] ..... B05C 15/00
(52) U.S. Cl. ..... 454/52; 118/326
(58) Field of Search ..... 454/50, 51, 52; 118/326, DIG. 7; 34/666, 116, 117

(56) References Cited

U.S. PATENT DOCUMENTS

| | | | | |
|---|---|---|---|---|
| 3,807,291 | | 4/1974 | Roberts . | |
| 4,367,787 | * | 1/1983 | Bradshaw | 165/35 |
| 4,537,120 | * | 8/1985 | Josefsson | 98/115.2 |
| 4,840,116 | * | 6/1989 | Murakami et al. | 98/115.2 |
| 4,926,746 | | 5/1990 | Smith . | |
| 5,113,600 | * | 5/1992 | Telchuk | 34/90 |
| 5,480,349 | | 1/1996 | Kolta . | |
| 5,512,017 | * | 4/1996 | Gore et al. | 454/52 |
| 5,676,753 | * | 10/1997 | Josefsson et al. | 118/326 |
| 5,762,548 | * | 6/1998 | Milojevic et al. | 454/52 |

FOREIGN PATENT DOCUMENTS

| | | |
|---|---|---|
| 3430531 | 2/1986 | (DE) . |
| 0480664 | 4/1992 | (EP) . |
| 2534155 | 4/1984 | (FR) . |

* cited by examiner

*Primary Examiner*—Harold Joyce
*Assistant Examiner*—Michelle A. Mattera
(74) *Attorney, Agent, or Firm*—Martin A. Farber

(57) ABSTRACT

In vehicle spraying booths (1), air is supplied to and discharged from the inner chamber (1*a*) by an air feeding device. The air supplied is conditioned so that its temperature lies in a desired temperature range and air pollution limit values can be ensured for a person working in the inner chamber (I). A displacement device (10) with a vehicle receiving region that can be moved in at least one direction of displacement in the spraying booth (1) is arranged in the spraying booth (1). This reduces the required booth width to the sum of the width required for working and the width of the vehicle being sprayed, and the required booth length to the length of the vehicle being treated. In order to direct air between the air feed device (20) and desired areas of the chamber, at least two air supply regions (21*b*, 23*b*; 21*b*', 23*b*') in communication with ducts (21–23) of the air feeding device (20) and provided with closable openings (18) into the inner chamber (1*a*) are located in at least one horizontal chamber delimiting region. The openings (18) open into uniformly distributed areas of the chamber. Openings (18) of each air supply zone (21*b*, 23*b*; 21*b*', 23*b*')are located in each area of the chamber, and thus each area of the chamber can communicate with each air supply zone (21*b*, 23*b*; 21*b*', 23*b*'). The smaller size of the booth and the directed air currents make it possible to reduce fresh air throughput and the energy required to heat the fresh air.

12 Claims, 4 Drawing Sheets

SPRAYING BOOTH AND CIRCULATION SYSTEM FOR A WORKING CHAMBER

FIELD AND BACKGROUND OF THE INVENTION

The invention relates to a spraying booth and to a circulation system.

For coating paints and lacquers on large objects, particularly on cars, spraying procedures are mostly applied that are carried out in spraying booths. In order to draw overspray and, particularly, freed solvents off the interior of the spraying booth, a circulation flow of air through the booth is set going. In this way, high concentration of harmful substances in the interior can be avoided. Even in persons, who have to work within the booth, have to wear protective masks, it is laid down to supply the inner room or working room always with fresh air. Before being allowed to flow in, the fresh air or ambient air is brought up to a desired temperature. In winter or at low ambient temperature, the fresh air has to be heated from an ambient temperature of 0° C., for example, up to about 20° C., i.e. room temperature. In summer or at high ambient temperature, the fresh air would have to be cooled down to a desired room temperature.

The size of the spraying booths is adapted to the average dimensions of the objects to be treated in such a manner that there is some working space around the objects to be placed in a central area of the interior to enable the working staff to spray onto the object from all sides. Spraying booths for passenger cars have an area of a length of substantially at least 7 m and width of substantially at least 4 m. A car to be treated is placed through a short lateral wall formed as an entrance door in the direction of the longitudinal axis of the booth into the center of the interior. The car stands then on a grid below which an exhaust air filter is mounted. Below the exhaust air filter is an exhaust air channel through which exhaust air streaming through the filter unit can flow to an air propulsion device. In order to provide space for the exhaust air filter and the exhaust air channel below the bottom of the booth, known spraying booths need a fundament of about 60 cm in depth.

The ceiling of the booth comprises a grid on which a supply of fresh air filter is lying, and an air channel above it which carries air from the air propulsion device to the upper side of the fresh air filter. Air supply through the fresh air filter and exhausting air through the exhaust air filter have to be chosen in such a manner that air in the interior sinks down as much free of turbulances as possible. Turbulences or any deviation from air sinking down in a laminar fashion lead to prolonged times of dwell of partial quantities of air which can also be enriched in paint particles and solvent.

With substantially uniformly sinking air, sinking speeds in the order of 0.25 m/s are provided. For a booth having a cross-sectional area of 28 $m^2$ (7 m×4 m), a throughput of air of 7 $m^3$/s or 25,000 $m^3$/h would result. In order to be able to heat such a large throughput quantity of air sufficiently, a heating device of high heating capacity, particularly of the order of 300 kW, has to be installed. For reducing the amount of heat required, plants have been built in which fresh air were mixed with up to 50% of exhaust air, and the air mixtures was subsequently introduced into the booth. The exhaust air has already the temperature desired and, thus, need not to be heated. By using mixed air, the proportion of solvents in the working area is increased.

A further known measure for reducing the amount of heat required consists in that part of heat energy of the exhaust air is transferred to the inflowing fresh air in a heat exchanger.

It shows, however, that, even with the known approaches using heat exchangers, the power of heat required is still high enough that it has to be produced by a burner. The use of a burner results in high expenses for approval and investment, because a fuel supply, a safe combustion chamber and a smoke exhaust conduit or a chimney are necessary. An electrical heating line would require an electrical connection of a large line cross-section. Installing such a connection involves high costs, and it is even doubtful whether such a high electrical power would be approved at all. In addition, the costs of current to be expected lead to very high operating costs.

SUMMARY OF THE INVENTION

The object of the invention is to devise a reasonable spraying booth which, at low energy consumption, provides sufficiently good and tolerable air conditions for a person working inside the booth.

When solving the problem, it has been recognized that high heat energy consumption is mainly due to the horizontal cross-section or the base area of the interior of the spraying booth. The throughput of air through the interior is the product of the horizontal cross-section times the desired sinking speed. The sinking speed should be more than 0.15 m/s, preferably substantially about 0.20 m/s, so that the overspray and solvent vapors are exhausted sufficiently quickly from the interior. In order to reduce the throughput of air and, thus, the proportion of fresh air to be heated in some cases, the horizontal cross-section of the interior should be diminished. In order that such diminishing the cross-section does not impede working around the object or car to be sprayed, the spraying booth according to the invention comprises a shifting device rendering the object or car shiftable within the spraying booth.

The shifting device comprises at least a holding area on which the object or the car, particularly its wheels, rests. The holding area is moveable in the spraying booth at least in one direction, the mobility being optionally ensured by wheels, particularly castor wheels, but preferably by a first guiding arrangement. The first guiding arrangement comprises preferably at least two parallel rails which extend, in particular, transversely to the axis of the booth and are fastened to the bottom of the booth, or their ends are mounted on the walls of the booth. On the rails, a rolling carriage having rolls or wheels running on the rails is displaceably arranged. The holding area is optionally fixed to the rolling carriage, preferably, however, a second guiding arrangement is formed between the rolling carriage and the holding area which renders the holding area displaceable on the rolling carriage.

With a rolling carriage guided on rails, a bottom surface may be arranged between the rails which needs only to have small bearing capacity and may, in particular, have an insulating function so that the flow of heat due to heat conduction through the bottom is minimized.

The direction of displacement of the second guiding arrangement is preferably orthogonal to the direction of displacement of the first guiding arrangement so that the object or passenger car together with its holding area is displaceable substantially arbitrarily within the booth. For working the left or right side of the car, the car is displaced so that its right or left side is close to the booth wall. With a shifting device having two guiding arrangement, the front side or the back side of the car may be displaced correspondingly towards one of the booth walls. Thus, it is ensured by the shifting device that a sufficiently large working area is available for treating each partial area of the car.

The required width of the booth is, thus, substantially the sum of a working width necessary for work and the width of the objects or cars to be treated. Therefore, for common passenger cars, a booth width of substantially 3 m and a booth length of substantially 6 m is sufficient. By providing a shifting device, the booth cross-section can be reduced to 18 $m^2$, two thirds of the common cross-section. Correspondingly, with an identical sinking speed (0.25 m/s), the throughput of air is reduced in comparison to known booths by a third to 4.5 $m^3$/s or 16,000 $m^3$/h. This means that with all known circulation procedures, thus both with supplying only fresh air and with supplying mixed air, a reduction by a third of heat energy or heating power required can be achieved by the facility of diminishing the cross-section.

For receiving cars, the holding area comprises preferably two elongated partial areas or planks spaced transversely to the longitudinal axis of the booth in such a manner that the car's wheels of the right side and the left side can be placed onto the first and second partial area. Since the two partial areas will be somewhat elevated above the bottom of the booth, ramps have to be provided over which the car can be rolled onto the partial areas. It is to be understood that the shifting device could also comprise a lifting device so that a car can be lifted to facilitate work in a lower region of the car.

As a further advantage, the shifting device offers the possibility of fastening the exhaust filter and the exhaust conduit to the shifting device above the bottom of the booth. To this end, an exhaust box having at least one suction opening is fastened to the shifting device together with the exhaust filter and the exhaust conduit in such a manner that the exhaust box is shiftable together with the holding area in at least one direction, particularly transversely to the longitudinal extension of the booth. In the case of a booth for cars, the exhaust box is preferably sized somewhat smaller than the smallest clearance to be expected between the wheels and is arranged in such a manner that a car can be pushed onto planks on either side of the exhaust box. The car may be displaced on or with the planks in longitudinal direction of the booth relative to the exhaust box. Optionally, however, the exhaust box is also displaceable with the holding area of the car in the direction of the second guiding arrangement.

The suction opening may be formed and arranged in any manner desired. Preferably, however, it extends substantially over the whole lower side of the exhaust box. Optionally, a plurality of suction openings, particularly equipped with a closure element, may be formed in the boundary of the box. In this way, it is possible to suck exhaust air from a certain preferred region of the room. In order to connect an exhaust box and its exhaust conduit displaceable in one direction to a stationary air propulsion device, optionally a flexible hose connection, but preferably a sealed slider arrangement is provided. Such slider arrangement may comprise, for example, a communication opening of the exhaust box being displaceable along a slot-shaped connecting opening to the air propulsion device, a slider ensuring that the two adjoining openings are open in an overlapping area only.

By arranging the exhaust box directly below the car, it can be ensured that the overspray and solvents may be sucked off directly within the space or region where they are released. A further advantage of such an arrangement consists in that a special fundament providing a clearance for the exhaust channel can be omitted when building the spraying booth. The spraying booth is directly built on a flat area of soil.

In order to ensure optimum air quality for a person working in the booth with a small throughput of fresh air and, thus, with small consumption of heat energy, introducing fresh air in a well-aimed manner is provided. To this end, at least two, preferably four, optionally even six, partial areas are each connected to a fresh air supply and a circulation supply conduit above the air supply filter or fresh air filter, the input openings of the supply conduits being provided with actuable closure elements. The latters are switched in such a manner during operation that each area is fed with only one type of air. Preferably, one half of the areas is fed with fresh air and the other half with recirculated air, the fresh air areas being chosen that they are just above the respective actual working area. Thus, the man who works within the working area is in a fresh air region.

Actuating the closure elements could optionally be done manually by the working man. Preferably, however, a control is provided which, depending on the position of the holding area or the car or in dependence upon the whereabouts of the working person and/or of the spraying device, determines the actual working area and actuates the closure elements correspondingly. After switching the closure elements over, a period of essentially 15 s is needed until a fresh air column has built up in the new area of space from the ceiling down to the bottom. Therefore, the control should change the working area only, when the working area determined remains unchanged at least during a comparable period.

By introducing fresh air in a well-aimed manner, good air quality in the working area can be achieved even with a small proportion of fresh air, namely 50% or optionally less of the total amount of air introduced. Since only the fresh air has to be warmed up, the quantity of heat required will be reduced to the proportion of fresh air relative to the total amount. Air quality is substantially improved when introducing fresh air and recirculated air separately into the working area than when introducing mixed air.

When after reducing the cross-section of the booth ⅔ of the usual area, the throughput of air is reduced to ⅔, and the proportion of fresh air is now reduced to 50% after introducing fresh air in a well-aimed manner, a total reduction of the fresh air throughput will result in ⅓ of the throughput needed heretofore in a booth. This means that instead of a fresh air throughput of 24,000 $m^3$/h already a fresh air throughput of 8,000 $m^3$/h will ensure the same air quality in the working area. In addition, it has been found that by sucking off below the car, a better aimed exhaust of overspray and released solvents is ensured so that one can work with a smaller sinking speed, for example with at least 0.15 m/s. By reducing the sinking speed to 0.19 m/s, the fresh air throughput can be decreased to 6,000 $m^3$/h, i.e. a quarter of the throughput of a booth of the prior art.

The heat power required for heating fresh air is, in some cases, reduced both by reducing the throughput and by using a heat exchanger. A preferred heat exchanger comprises two plate modules through which exhaust air flows in horizontal direction, while fresh air flows in vertical direction. In this way, 77% of the heat required for the fresh air can be transferred from the exhaust air to the fresh air so that a heating unit has to provide only about ¼ of the heat which is needed without a heat exchanger. By reducing the fresh throughput to ⅓ or ¼ and by using a heat exchanger, it is possible to limit the heating power to be installed to 1/12 or 1/16 of the heating power of a known booth. The effect of a heating power provided heretofore by a burner of 300 kW can now already been achieved with a heating power of 25 kW or 18 kW. Since the common heating power of 300 kW is somewhat over-dimensioned for a standard booth, it is possible already with a heating power of 10 kW–20 kW for an optimized booth to warrant a desired room temperature in the interior of the booth even with cold ambient or fresh air.

After a spraying step, mostly a drying or baking step will follow for which the booth is heated up to a temperature of 60°–80° C. heating is substantially effected by heating recirculated air. The fresh air proportion is substantially reduced to 10% or less. In order to be able to heat recirculated air and, particularly to reduce the proportion of fresh air, optionally an actuable channel setting flap is arranged in such a manner that part of the exhaust channel together with a part of the fresh air channel forms a further recirculation channel in which the heating unit and the fresh air fan are situated. In this way, the heating unit may also be used for heating the booth for the baking procedure. The required heating power depends, therefore, also upon the desired time period in which a drying and/or baking temperature should be attained. It is convenient to install a heating power of 50 kW in maximum, particularly 30 kW in maximum, and optionally of 10–20 kW.

This small heating power can be provided by an electrical heating unit without needing a special cross-section of the connecting cable. A known booth, only for energizing the electric drives of fans, for illumination and for the electrical parts of the burner have connecting cables for 40–60A which is sufficient for supplying an optimally dimensioned electric heating unit. Since the total throughput of air in a booth of smaller cross-section is smaller, the driving motors of the fans can be dimensioned smaller. Thus, if three motors of 1.5 kW are used instead of three motors of 4 kW, these motors require less electrical power by 7.5 kW which is almost sufficient to supply the electric heating unit.

The measures for reducing the throughput of fresh air and the required heating power enable operation of a praying booth without any burner. Accordingly, the expensive constructive measures needed for a burner can be omitted. An embodiment of the spraying booth comprising an exhaust box arranged above the bottom of the booth together with an electric heating unit can be built as an installation element substantially without engineering measures on any flat soil.

The throughput of fresh air of a large spraying booth which, for example, is used for spraying trucks or rail cars can, in some cases, be brought down to a range of 6,000 to 8,000 $m^3/h$ alone by introducing fresh air in a well-aimed manner through a small partial area of the whole ceiling already without reducing the horizontal cross-section of the booth and, thus without providing a shifting device. The partial area or working area aerated by this throughput amounts to 9 $m^2$ and corresponds, as mentioned above, to half the ground surface of a booth for passenger cars having a ground surface of 18 $m^2$.

When aerating and exhausting a large booth or space having a working area, the extension of which amounting to only a small portion of the total area, it is also convenient, apart from introducing preferably fresh air and recirculated air in a well-aimed manner, to suck heavily charged exhaust air in a well-aimed manner separated from the less charged room air or recirculating air. This means that, analogously to introducing fresh air in a well-aimed manner into the actual working area and recirculated air in the remaining area, the air exhausted from the room can be exhausted through separated channels as an exhaust air and a recirculating air. In doing this, exhaust air is sucked off from an area where harmful substances are released, while recirculating air is sucked from the remaining area.

Thus, the invention discloses, in a very general manner, a circulation system for working rooms of a minimum throughput of fresh air which comprises at least two separated channel or conduit portions in at least one room defining region, either in the bottom region and/or the ceiling region, which comprises closable connecting openings towards the interior. The connecting openings open preferably into uniformly distributed regions of a room, optionally separated by separating elements within the region of the connecting openings, and are particularly separated from the interior by filters. In addition, at least one connecting opening of each channel portion is assigned to each room region or, at least, can be assigned to it. When using the channel portions as air supply channels, it is possible to feed each room region with the desired air supply, such as fresh air or recirculated air or room air charged more or less. When using the channel portions as exhaust air channels, exhausted air from each room region can be conveyed separately as an exhaust air and a recirculating air, in cases even as a differently charged circulation air. Circulation in a room may either be set going from the ceiling towards the bottom or vice-versa.

In circulation systems, which enable both spatially separated supplying and exhausting of two types of air each, it is preferably provided that fresh air is supplied to a working area, and air charged due to the working procedure is exhausted as an exhaust air. Recirculated air can be supplied to the remaining room or room region that is actually not used as a working area, the recirculated air being already conveyed from this remaining room region. By such a functional symmetrical air supply and exhaust system, a substantially laminar field of flow can be achieved having much smaller sinking or rising speeds in the interior which ensures optimum air conditions with the smallest possible energy consumption and without any unpleasantly strong draught. If the channel system in the ceiling region is substantially identical to that in the bottom region, control and opening and closing the connecting openings too can be effected in a substantially identical manner.

Even if separated channel or conduit portions are formed only in the ceiling region or only in the bottom region, it may be advantageous if the same are not used for supplying separated types of air, but for exhausting air separately. Of heavily charged exhaust air conveys the majority of harmful substances, the remaining exhausted room air can be resupplied into the whole room together with fresh air as a mixed air having an extremely small concentration of harmful substances. The better all harmful substances can be picked up separated from non-charged room air within the region of their release, the smaller is the required proportion of fresh air.

It is also possible to have only one channel portion stationary, instead of two separated channel or conduit portions installed stationarily and having closable connecting openings, but to form the other channel with a suction or output opening being displaceable substantially over the whole room region. This means that in the case of a spraying booth, as described above, which has a suction opening in a displaceable exhaust box, a stationary suck-off arrangement could be provided in addition to this exhaust box. For example, either an areal exhaust suction according to the prior art or a linear exhaust suction, particularly in at least one edge region between a lateral wall and the bottom, could be provided. The stationary exhaust arrangement would convey the less charged room air, while the displaceable suction opening is arranged in the respective actual working area to convey the heavily charged air. It is to be understood that analogously also a displaceable opening may be used as a supply opening for fresh air, and a stationary opening as a supply opening for recirculated air.

The displaceable suction or output openings are preferably moved manually to the respective working area. If they are coupled to the object to be treated or to a holding area for it, they need not to be moved separately. However, it also possible to provide an actuating device together with a control which ensures that the actual working area, as described above, is determined, and the opening is moved to it.

A circulation system according to the invention may be adapted to the most different room and working conditions in an optimal way. It has only to be decided whether a well-aimed supply of fresh air, well-aimed sucking of heavily charged room air or both are to the fore. In accordance with this decision, separated channel systems are formed for the air supply or for fresh air and recirculated air, for sucking off or for exhaust air and recirculating air, or both for the air supply and for exhausting.

BRIEF DESCRIPTION OF THE DRAWINGS

The drawings will explain the invention with reference to embodiments schematically illustrated in which.

DETAILED DESCRIPTION OF THE PREFERRED EMBODIMENT

Figure 1:
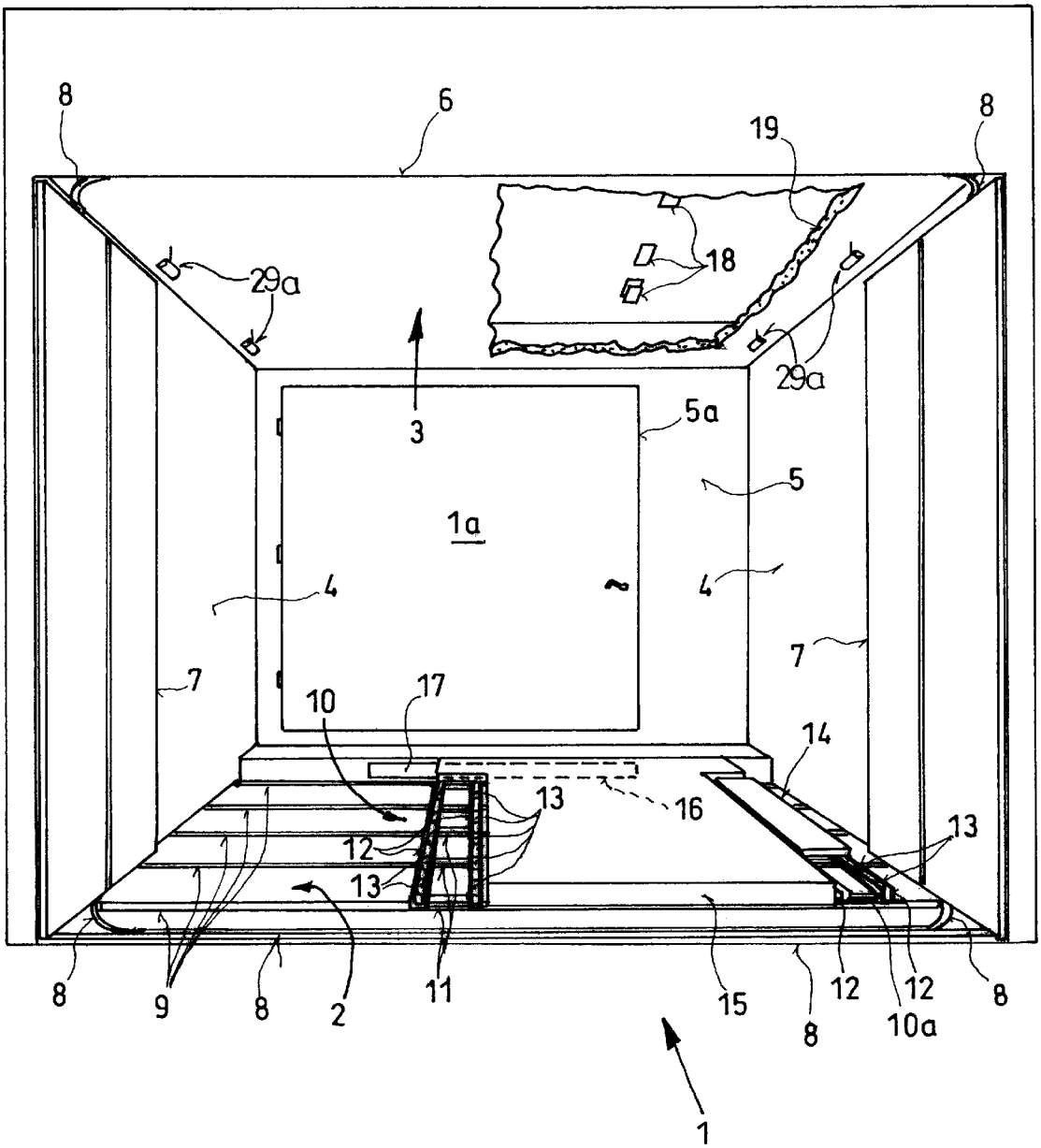
FIG. 1: shows a respective view of a spraying booth having a carriage, an exhaust box and closable air entrance openings.

FIG. 1 shows a spraying booth 1, the interior 1*a* of which is surrounded by a bottom 2, a ceiling 3, two long lateral walls 4, a short lateral wall or real wall 5 and a closable door opening 6. The door opening 6 may be closed by door elements 7 guided in door guidances 8. When the door elements 7 in an open position adjoin the long lateral walls 4, the room required for the spraying booth is reduced by the pivoting range of the usual wings of door. On the bottom 2, rails 9 extend transversely to the longitudinal axis of the booth and parallel to each other. At least part of the rails 9 extends preferably from one long lateral wall to the other. On the rails 9, a carriage 10 is located which comprises first profiles 11 assigned to the rails 9, extending parallel to them and having first rolls or wheels rotatably mounted on them. Transversely to the first profiles 11, there are second profiles 12 fixed to the first ones. Two parallel second profiles 12 are provided at both lateral end regions of the first profiles 11 and are provided with rotatable second wheels 13 in such a manner that at both sides on the second wheels 13 a plank 14 each can be arranged on the carriage 10 displaceable in longitudinal direction of the booth.

The wheels of a car to be sprayed will be positioned onto the planks 14, preferably via ramps assigned to the planks. In this position, the car is displaceable together with the carriage 10 between the two long lateral walls transversely to the longitudinal axis of the booth. By displacing the planks 14 on the carriage 10 in the direction of the longitudinal axis of the booth, the front side or the rear of the car may be moved either towards the rear wall 5 or towards the door opening 6. By this possibility of movement, it is ensured that the car can be treated all around even in a booth whose width or length corresponds only to the sum of an average car width or length and one required working width. The respective portion of the car which is not treated is pushed towards one wall or corner of the booth in order to provide the necessary working area adjoining to the portion to be treated.

In order to be able to suck overspray and released solvents off directly at the car and in the region of their development, an exhaust box 15 is preferably arranged on the carriage 10 between the planks 14. The suction opening of the exhaust box 15 is preferably formed at its underside which is somewhat spaced from the bottom 2. Within the exhaust box 15, air sucked off reaches a communication opening which adjoins displaceably to a connecting opening 16 of an air propulsion device. To form the displaceable connection substantially in a sealing manner, sealing elements are arranged around at least one of the openings. To ensure connection over the desired length of displacement, the connecting opening 16 is provided the direction of displacement with slider elements 17 on both sides which diminish the connecting opening when the communication opening moves away.

The air propulsion device is situated behind the rear wall 5 or behind a service door 5*a* and conveys separately fresh air and recirculating air to closable connecting openings 18 in the ceiling region. Between the connecting openings 18 and the inner space 1*a* of the booth is an air supply filter 19.

Figure 2:
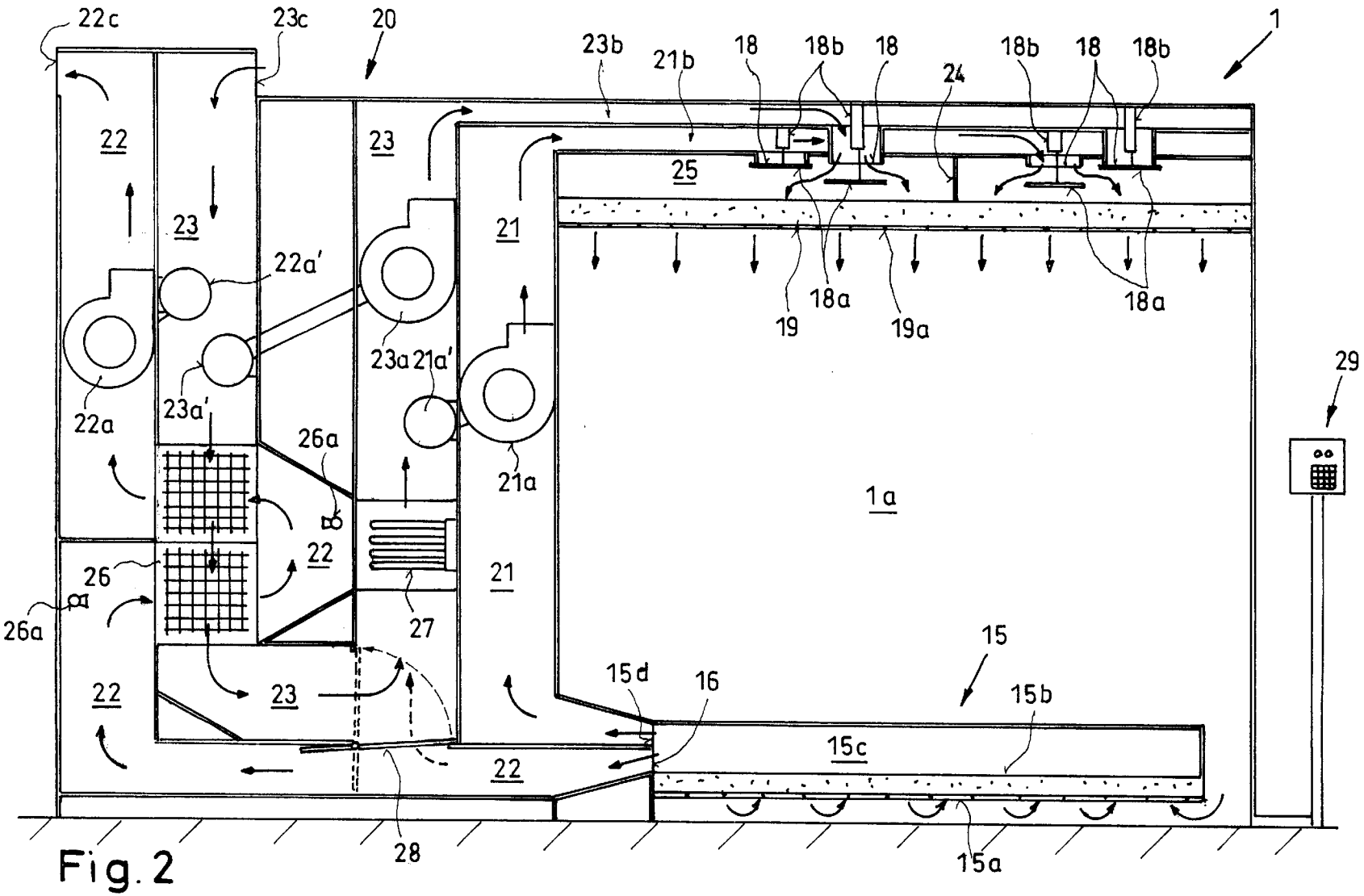
FIG. 2: is a schematic representation of a vertical cross-section of a spraying booth and its air propulsion device.

FIG. 2 shows schematically those parts of the spraying booth 1 which are important for air circulation as well as its air propulsion device 20. The exhaust box 15 comprises an exhaust filter 15*b* above an exhaust grid 15*a* and above it an exhaust region 15*c* which is connected through the communication opening 15*d* to the connecting opening 16 of the air propulsion device 20. Within the air propulsion device, an air recirculating channel 21 and an exhaust channel 22 communicate with the connecting opening 16. Within the air recirculating channel, a recirculating fan 21*a* is located that conveys sucked off room air as a recirculated air through the air recirculating channel 21, an adjoining supply channel 21*b* for recirculating air and connecting openings 18 into distribution spaces 25, which are preferably separated by partitions 24, above the air supply filter 19. The air supply filter 19 rests preferably on an air supply grid 19*a*.

The exhaust channel 22 leads twice in horizontal direction through a two-part heat exchanger 26, an exhaust air is conveyed by an exhaust fan 22*a* within the exhaust channel 22 towards an exit opening 22*c*. Fresh air enters through a suction opening 23*c* into a fresh air channel 23 that leads through the heat exchanger 26 and through a heating zone including a heating unit 27 to a fresh air supply channel 23*b*. From the fresh air supply channel 23*b*, the fresh air propelled by a fresh air fan 23*a* enters distribution spaces 25 through the connecting openings 18 and reaches the inner space 1*a* of the booth through the air supply filter 19.

A cooling unit for cooling fresh air comprises preferably at least one water supply and at least one nozzle unit 26*a* for producing a spray of water. The spray of water is preferably lead through the heat exchanger 26 together with exhaust air and extracts heat from the fresh air by evaporation. The fans 21*a*, 22*a*, 23*a* are driven by motors 21*a'*, 22*a'*, 23*a'*. To prevent ignition of solvent vapors by sparks of the electric motors, the motors are all located in the fresh air channel 23.

In order to be able to introduce fresh air and recirculated air in a well-aimed manner into desired portions of inner space 1*a*, the connecting openings 18 lead from each of the supply channels 21*b*, 23*b* to at least two, preferably four and optionally even six or eight partial areas of the ceiling which are substantially equally dimensioned. In addition, the connecting openings are provided each with an actuable closure member 18*a*. Optionally, a manual actuating device in each partial area of the ceiling enables switching from fresh air supply to recirculated air supply and vice-versa. Preferably, however, a control unit is provided for controlling actuation elements 18*b* for the closure members 18*a*. The control unit is preferably coupled to a detection device 29*a* for detecting the actual working area, the detection device optionally detecting the position of the planks, but preferably the position of a working person or his spraying tool.

In order to be able to dry a sprayed car, preferably an actuable flap 28 is provided in the air propulsion device which, for providing a further recirculation channel, makes it possible to connect part of the exhaust channel 22 with part of the fresh air channel 23 in which the heating unit 27 is also situated. Depending on the position of the flap 28 it can be ensured that a small proportion of fresh air together with exhaust air reaches the inner space through the heating unit 27, while some exhaust air is blown off accordingly.

For controlling the motors 21*a*′, 22*a*′, 23*a*′, the flap 28 and the actuating elements 18*b*, a control unit 29 is provided.

Figure 3:
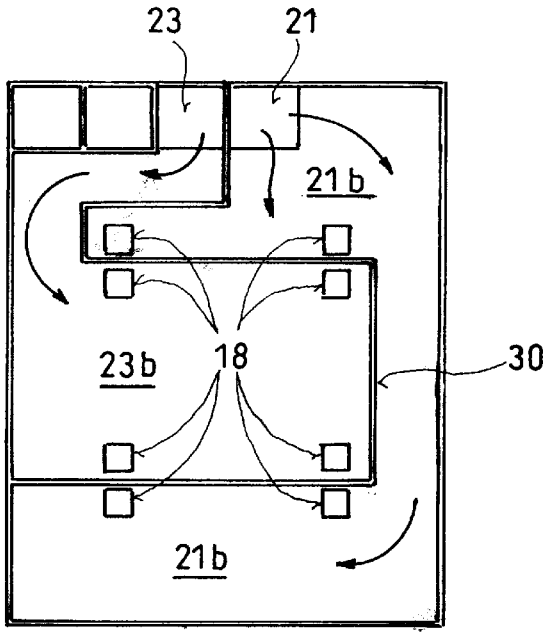
FIG. 3: is a horizontal cross-section through separated channels in the region of a ceiling.

FIG. 3 shows a labyrinth-like construction of the two separated supply channels 21*b* and 23*b* which makes it possible in a horizontally extending cavity to form the two separated channels 21*b* and 23*b* adjacent to one another at low expenses by providing a labyrinth partition wall 30.

Figure 4:
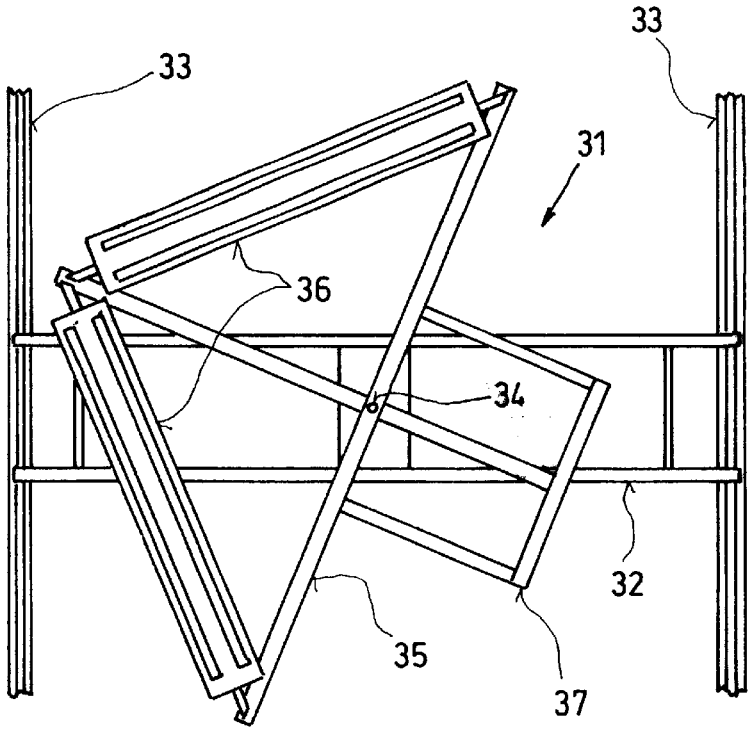
FIG. 4: is a view from below of a displaceable holding system comprising lighting units.

FIG. 4 shows a holding system 31 which comprises a sliding carriage 32 displaceable on rails 33, and a part 35 rotatable about a vertical axis of rotation 34 situated substantially in the center of the sliding carriage. The rotatable part 35 comprises lighting units 36 and a mounting portion 37. The mounting portion 37 serves, for example, for mounting an infra-red heating unit or, optionally, of an exhausting or air supplying element. The rails 33 extend close to the ceiling and along the long lateral walls 4 so that the lighting units 36 as well as heating or air guiding elements arranged on the rotatable part 35 may be moved to possible working areas.

Figure 5:
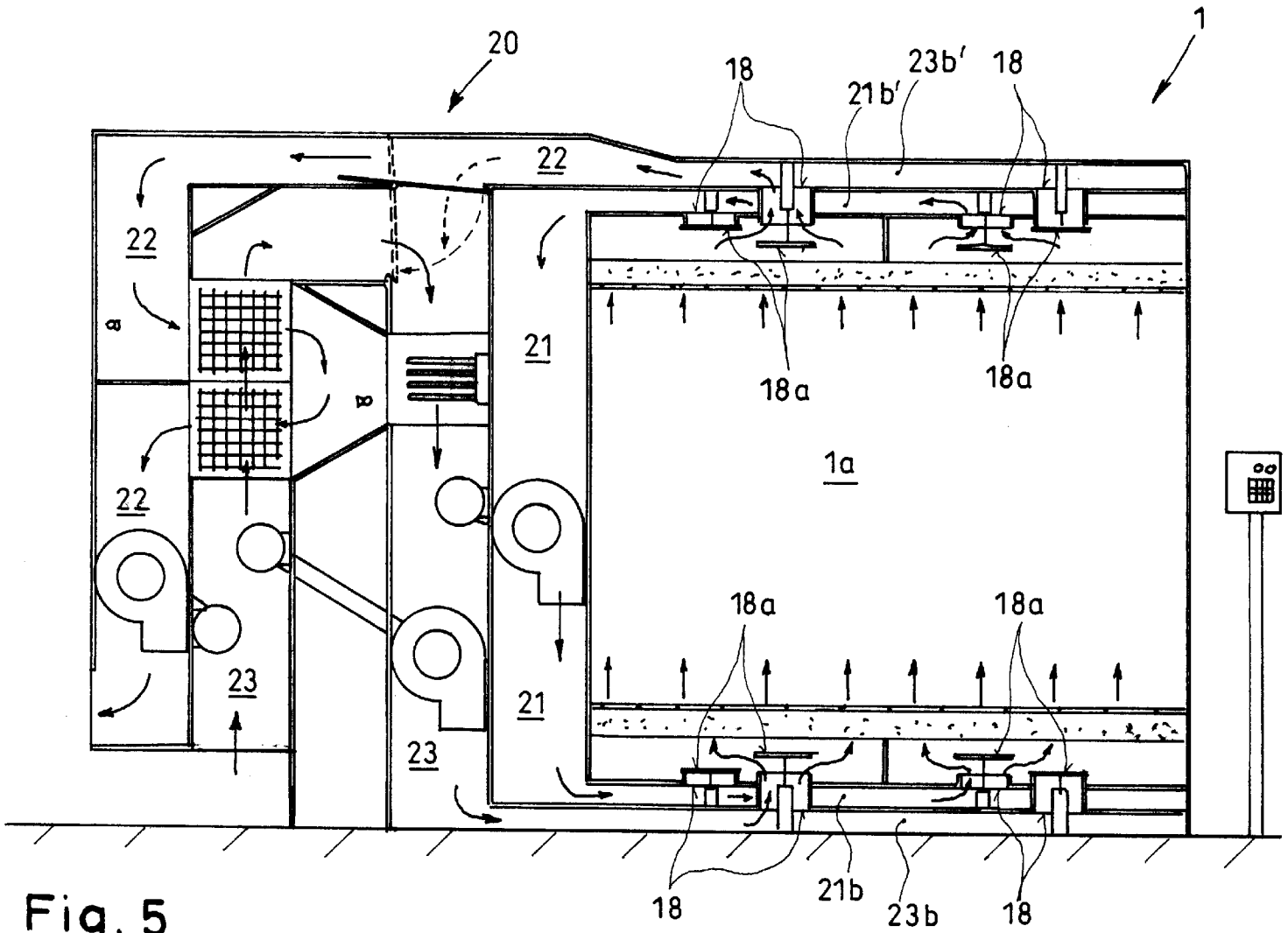
FIG. 5: is a schematic representation of a vertical cross-section of a spraying booth having two separated channel systems each in the ceiling region and in the bottom region.

FIG. 5 shows a spraying booth 1 where an air flow is set going from the bottom to the ceiling in its interior 1*a*. In order to be able to suck exhaust air which exists from the interior 1*a* in the region of the ceiling in a locally separated manner as an exhaust air and a recirculated air, on the one hand, and to introduce supplied air in the bottom region locally separated as fresh air and recirculated air, on the other hand, a pair of separated channels 21*b*, 23*b* and 21*b*′, 23*b*′, having closable connecting openings 18 towards the interior 1*a*, are formed each in the bottom region and the ceiling region. The connecting openings 18 open into substantially uniformly distributed room regions, in each room region connecting openings 18 of each channel 21*b*, 23*b* and 21*b*′, 23*b*′, being arranged, thus rendering each room region connectable with each channel 21*b*, 23*b* and 21*b*′, 23*b*′.

The air propulsion device 20 corresponds substantially to the device 20 illustrated in FIG. 2, top and bottom being inverted to achieve a reversed flow of air in the interior 1*a*. The suction side of the channels 21*b*′, 23*b*′ in the region of the ceiling communicates with the exhaust channel and the air recirculating channel 22 and 21, while the pressure side of the channels 21*b*, 23*b* in the bottom region communicates with the fresh air channel and the air recirculating channel 23 and 21. The schematic representation shows a left room region and a right room region. The closure elements 18*a* in the left region are positioned in such a way that fresh air can enter and air sucked off is conveyed as exhaust air. In the right region, the closure elements 18*a* are positioned in such a manner that recirculated air enters and air sucked off is supplied again as recirculated air.

It will be understood that the elements of the embodiments described could be used in different combinations.

What is claimed is:

1. Spraying booth for treating objects all around, such as cars, comprising an inner space (1*a*) surrounded by lateral walls (4, 5), at least one closable door opening (6), a ceiling (3) and a bottom surface (2), and an air propulsion device (20) which renders air introducible into the inner space (1*a*) and exhaustible from the inner space (1*a*), the introduced air being conditionable in such a manner that its temperature is within a desired temperature range and that tolerance values of air pollution for a person working within the inner space (1*a*) can be maintained, a shifting device (10) including a movable holding area for holding an object is provided, the holding area being displaceable at least transversely to the longitudinal direction of the booth, that an suction system having at least one suction opening (15*a*) is mounted on said shifting device (10), and that the required width or length of the booth in shifting direction corresponds substantially to the sum of a working width necessary for work and the width or length of the objects or cars to be treated.

2. Spraying both according to claim 1, characterized in that at least one fresh air supply channel and at least one recirculated air supply channel (23*b*, 21*b*) are formed above the ceiling (3) of the booth and/or an air supply filter (19), and that each supply channel (23*b*, 21*b*) comprises at least one connecting opening (18) to said inner space (1*a*) of the booth in at least two substantially equally sized partial areas of the ceiling, the connecting openings (18) being equipped with an actuable closure member (18*a*), and that at least one of the following characteristics is provided a) a manual actuation device allows in each partial area of the ceiling switching over from fresh air supply to recirculated air supply and vice-versa; and b) a control unit (29) for controlling an actuation device (18*b*) for the closure members (18*a*) is coupled to a detection device for detecting the actual working area, the detecting device rendering detectable the position of the holding area and the position of a working person and spraying tool.

3. Spraying booth according to claim 1, characterized in that the air propulsion device (20) comprises a channel system (21, 22, 23) and at least three fans (21*a*, 22*a*, 23*a*) driven by motors (21*a*′, 22*a*′, 23*a*′) which are situated in fresh air channel portions, wherein a) an exhaust fan enables conveying an exhaust air proportion from at least one suction opening (15*a*, 18) leading to the inner space (1*a*)through an exhaust channel (22) towards an exit opening (22*c*);

b) a fresh air fan (23*a*) enables conveying fresh air through a fresh air channel (23) to at least one fresh air supply channel (23*b*); and c) a recirculated air fan (21*a*) enables conveying a room air proportion from at least one suction opening (15*a*, 18) leading into the inner space (1*a*) through a recirculated air channel (21) to at least one recirculated air supply channel (21*b*).

4. Spraying booth according to claim 3, characterized in that at least one of the following characteristics is provided, a) within the air propulsion device (20) is a heat exchanger (26) arranged in such a way within the exhaust channel and in the fresh air channel 22, 23) that fresh air is preheated by the exhaust air;

b) within the air propulsion device (20) is a cooling unit for cooling fresh air which includes at least one water supply and at least one nozzle unit (26*a*) for producing a spray of water, the spray of water being enable to be guided through the heat exchanger (26) together with exhaust air, thus, rendering heat from the fresh air extractable by evaporation; and c) within the fresh air channel (23) of the air propulsion device (20) is an electrical heating unit (27) and an actuable channel setting flap (28) arranged in such a way that part of the exhaust channel (22) together with part of the fresh air channel (23) form another recirculated air channel in which the heating unit (27) and the fresh air fan (23*a*) are situated so that said heating unit (27) may also be used for heating the booth for a baking procedure.

5. Spraying booth according to claim 1, characterized in that the shifting device (10) comprises first guide means and second guide means (9, 11, 12–14) extending orthogonally thereto, so that the holding area is displaceable arbitrarily within the booth (1), the holding area including two planks (14) for holding cars laterally spaced from each other in correspondence with possible track widths, the first guide means (9, 11) including at least two parallel rails (9) extending transversely to the longitudinal axis of the booth and a carriage (10) displaceable on the rails, and that said second guide means (12–14) includes rails (12) mounted on said carriage (10) and planks (14) assigned to respective pairs of rails (12), wheels being provided between said pairs of rails (12) and said planks (14) for enabling said shifting movement which are rotatably supported either on said pairs of rails (12) or on said planks (14).

6. Spraying booth according to claim 1, characterized in that said suction system is situated above the bottom (2) of the booth and comprises an exhaust box (15) having at least one suction opening (15*a*) and includes an exhaust filter (15*b*) and an a exhaust area (15*c*), said suction system being displaceable at least transversely to the longitudinal direction of the booth, and that at least one of following characteristics is provided a) the exhaust box (15) is situated between two planks (14) which serve as said holding area, the planks (14) being movable relative to said exhaust box (15);

b) said suction openings (15*a*) extends over the whole underside of the exhaust box (15), however, a plurality of suction openings equipped with a closure element, are formed in the boundary of the box; and c) said exhaust box (15) or its exhaust area (15*c*) displaceable in at least one direction is connected to a stationary air propulsion device (20), through a flexible hose connection and through a sealed slider arrangement, a communication opening (15*d*) of the exhaust area (15*c*) being slideable along a slot-shaped connecting opening (16) of the air propulsion device (20), slider means (17) ensuring that said openings (15*c*, 16) adjacent to each other are open only in overlapping area.

7. Circulation system for a working room, particularly for a spraying booth (1), comprising an air propulsion device (20) which renders conditioned fresh air introducible into an interior (1*a*) through a fresh air channel (23) and renders air from the interior (1*a*) conveyable as exhaust air through an exhaust air channel (22) and as recirculated air re-introducible into the interior (1*a*) through a recirculated air channel (21), wherein at least two separated channels (21*b*, 23*b*, 21*b*, 23*b*′) for supplying at least two different air flows in parallel are communicating with corresponding channels (21–23) of the air propulsion device (20) and each having closable connecting openings (18) to the interior (1*a*) are formed in at least one room region that open into substantially uniformly distributed room regions, connecting openings (18) of each channel (21*b*, 23*b*, 21*b*′, 23*b*′) being arranged in each room region so that each room region may be connected to each channel (21*b*, 23*b*, 21*b*′, 23*b*′) to enable a well-aimed movement of air between said air propulsion device (20) and any desired room region, a detection device for detecting the actual working area, and a control unit coupled to it for controlling the actuating elements (18*b*) for the closure members (18*a*) renders that room portion, in which the actual working area is situated, automatically connectable with the desired channel (21*b*, 23*b*, 21*b*′, 23*b*′) and the other room regions with a different channel (21*b*, 23*b*, 21*b*′, 23*b*′).

8. Circulation system according to claim 7, wherein at least one of following characteristics is provided, a) filters (19) are arranged between the connecting openings (18) and the interior (1*a*);

b) connecting openings (18) of different room regions are separated from each other by partition walls (24);

c) two separated channels are formed in the region of the ceiling and have the pressure side communicating with the fresh air channel and/or the recirculated air channel;

d) two separated channels are formed in the bottom region and have the suction side communicating with the exhaust channel and the recirculated air channel;

e) two separated channels (23*b*′, 21*b*′) are formed in the region of the ceiling and have the suction side communication with the exhaust channel and the recirculated air channel (22, 21); and f) two separated channels (23*b*, 21*b*) are formed in the bottom region and have the pressure side communicating with the fresh air channel and/or the recirculated air channel (23, 21).

9. Circulation system according to claim 7 wherein at least one first connecting channel (15*c*), which communicates with a channel of the air propulsion device (20) is formed and includes at least one connecting opening 15*a*) to the interior (1*a*), said an opening being shiftable and that a second connecting channel separated from said first connecting channel (15*c*) and in communication with a channel of said air propulsion device (20) is communicating with the interior (1*a*) through at least one stationary opening which extends over an area or along a line.

10. Circulation system for a working room, comprising an air propulsion device for introducing conditioned fresh air into an interior of the working room through a fresh air channel (23) and exhaust air through an exhaust air channel (22) as recirculated air into the interior through a recirculated air channel (21) wherein two separated channels (21*b*, 23*b*, 21*b*′, 23*b*′) communicating with the fresh and exhaust air channels and having closable connecting openings (18) to the interior are formed to open into uniformly distributed room regions of the the working room with the connecting openings of each separated channel being arranged in the room regions so that each room region may be connected to each separated channel to enable a well-aimed movement of air between said air propulsion device and any desired room region and control apparatus for connecting room regions with ones of the separated channels.

11. Circulation system for a working room, comprising an air propulsion device for introducing conditioned fresh air into an interior of the working room through a fresh air channel (23) and exhaust air through an exhaust air channel (22) as recirculated air into the interior through a recirculated air channel (21) wherein two separated channels (21*b*, 23*b*, 21*b*′, 23*b*′) communicating with the fresh and exhaust air channels and having closable connecting openings (18) to the interior and which are separated from each other by partition walls and filters (19) arranged therebetween are formed to open into uniformly distributed room regions of the working room with the connecting openings of each separated channel being arranged in the room regions so that each room region may be connected to each separated channel to enable a well-aimed movement of air between said air propulsion device and any desired room region and having two other separated channels formed in the bottom region of the working room communicating with the fresh air and recirculated air channels and having control apparatus for connecting room regions with ones of the separated channels.

12. Circulation system for a working room, comprising an air propulsion device for introducing conditioned fresh air into an interior of the working room through a fresh air channel (23) and exhaust air through an exhaust air channel as recirculated air into the interior through a recirculated air channel (21) wherein two separated channels (21*b*, 23*b*, 21*b*′, 23*b*′) communicating with the fresh and exhaust air channels and having closable connecting openings (18) to the interior are formed to open into uniformly distributed room regions of the working room with the connecting openings of each separated channel being arranged in the room regions so that each room region may be connected to each separated channel to enable a well-aimed movement of air between said air propulsion device and any desired room region and control apparatus for connecting room regions with ones of the separated channels and wherein said working room has a connecting channel (15*c*) communicating with said air propulsion device and which is formed with a connecting opening (15*a*) to the interior of the working room and which is shiftable and having a second connecting channel separated from said first connecting channel (15*c*) and in communication with the air propulsion device (20) and communicating with the interior of the working room through at least one stationary opening which extends over an area or along a line.

* * * * *